United States Patent [19]

Benin

[11] 4,241,883

[45] Dec. 30, 1980

[54] MANUALLY OPERATED BOBBIN CHUCK

[75] Inventor: Joshua Benin, Newark, Del.

[73] Assignee: E. I. Du Pont de Nemours and Company, Wilmington, Del.

[21] Appl. No.: 69,751

[22] Filed: Aug. 24, 1979

[51] Int. Cl.[3] ..... B65H 54/54; B65H 75/30

[52] U.S. Cl. ..... 242/46.4

[58] Field of Search ..... 242/46.4, 46.2, 46.3, 242/46.6, 72, 72.1

[56] References Cited

U.S. PATENT DOCUMENTS

| | | | |
|---|---|---|---|
| 3,166,263 | 1/1965 | Smith, Jr. et al. | 242/46.4 |
| 3,779,472 | 12/1973 | Boggs | 242/46.4 X |
| 3,977,616 | 8/1976 | Owens et al. | 242/46.4 |
| 4,142,690 | 3/1979 | Karle et al. | 242/46.4 |

*Primary Examiner*—Stanley N. Gilreath

[57] ABSTRACT

An improved collet type bobbin chuck which uses mating tapered surfaces to produce radial gripping of the bobbins without dependence on centrifugal force. A manually operated spring mechanism is used to change the chuck from a bobbin releasing to a bobbin gripping mode.

1 Claim, 4 Drawing Figures

MANUALLY OPERATED BOBBIN CHUCK

BACKGROUND OF THE INVENTION

This invention relates to a bobbin chuck for use on a surface-driven yarn winding apparatus which operates at high speeds. More particularly, it relates to rotatable chucks with means for gripping and releasing a bobbin that are manually operable in the grip-release mode.

It is well recognized in the textile trade that certain operations can be conducted more economically when the feed yarn is provided on larger packages, that is, on packages which contain a greater length of yarn. It is also obvious to those familiar with the synthetic fiber manufacturing processes that, within broad limits, the higher the yarn speed at windup the more economical is the process. However, the higher speed of windup in combination with the heavier packages leads to a problem in that the packages spin on the chuck as they are braked to a stop for doffing which over a relatively short period of time damages the chuck and the bobbins on which the yarn is wound. Since rapid braking is a necessary part of the efficient high-speed process, a chuck is required which is capable of more positively gripping the bobbin so as to prevent the damaging free-wheeling spin on braking.

SUMMARY OF THE INVENTION

A bobbin chuck for mounting replaceable bobbins on the external surface thereof comprising: a central shaft; a tubular member mounted for rotation on said shaft and concentric therewith; a sleeve having a plurality of openings disposed in a concentric relationship about said tubular member, said sleeve being movable axially with respect to said tubular member and rotatable therewith; a plurality of camming members carried by said tubular member and supporting said sleeve in said concentric relationship, said camming members having tapered camming surfaces; a plurality of radially and axially movable cam followers having mating surfaces engageable with the camming surfaces and extending through the openings in the sleeve for gripping bobbins on said chuck; resilient means seated against said shaft and said sleeve for urging said sleeve axially in one direction to urge the camming surfaces of said cam follower against said tapered camming surface to move said cam followers into a gripping position; and a means located at the end of the chuck for moving the sleeve and the camming member axially in a direction opposite to said one direction to a release position.

DETAILED DESCRIPTION OF THE ILLUSTRATED EMBODIMENTS

Figure 1:
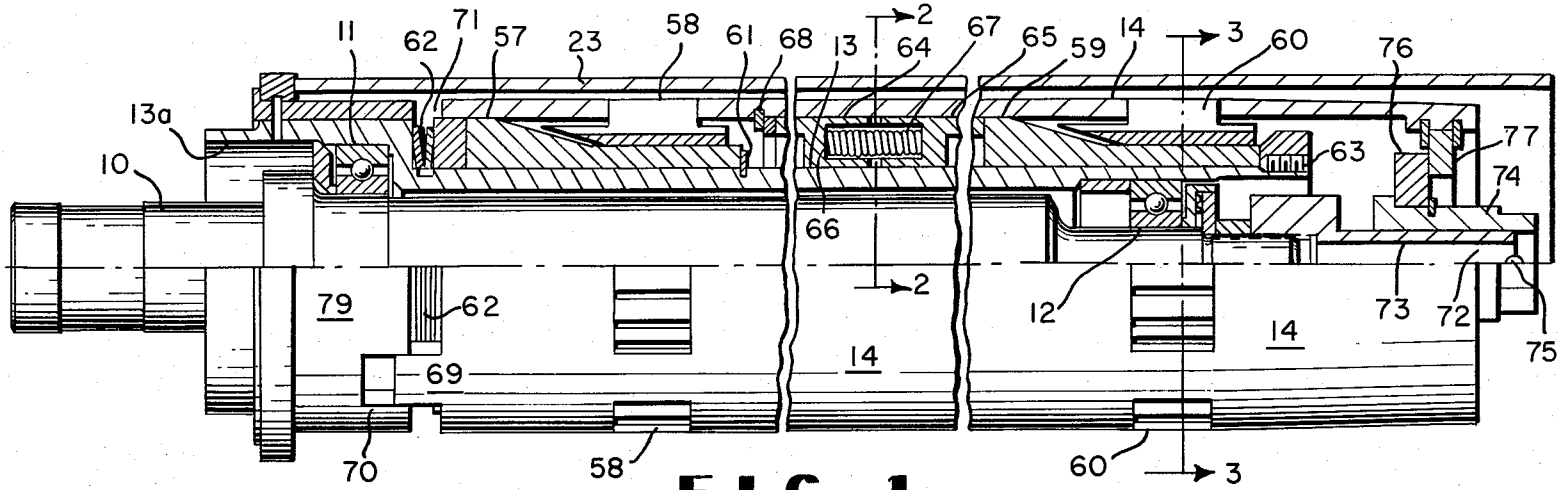
FIG. 1 is a side elevational view, partially in cross-section, of the chuck of this invention.

Referring to FIG. 1, the chuck generally comprises a nonrotating steel shaft 10 which is adapted to be secured to a swing arm (not shown) at its left end, ball bearings 11, 12 on the shaft which support a steel tubular member 13 which extends for substantially the entire length of the chuck, serving to support and guide bobbin gripping members and other parts to be described hereinafter and, surrounding the tubular member 13 but spaced radially outward from it, an apertured aluminum sleeve 14 which is generally coextensive with the tubular member 13. The chuck carries a single bobbin 23, and the chuck gripping and chuck release are effected essentially manually. The chuck is shown in the release or nongripping mode. The member 13 carries the one-piece sleeve 14 on mating tapered members 57 and 58 at the left end and 59 and 60 at the right end; in general these operate to expand the bobbin gripping portions 58 and 60 radially outward but they are actuated somewhat differently from each other. The tapered members 57 and 59 are made of Delrin ® acetal resin and are of one-piece construction but are split in one location (not shown) through their entire length to permit them to be squeezed inwardly against tube 13 during clamping thereby eliminating all radial clearance. The tapered members 58 and 60 are made of elastomer such as Adiprene ® urethane rubber or Hytrel ® polyester but are each made in two 165° segments to permit free radial movement.

On the left end the tapered member 57 is generally located relative to the tubular member 13 by means of snap ring 61; however, a small amount of axial "float" is possible but is resisted by Belleville washers 62 acting as a spring against the shoulder on member 13. The axial "float" provides an advantage in that the members 58 and 60 are brought to bear on a bobbin in parallel rather than serially; i.e., when the chuck is actuated to engage a bobbin, the Belleville spring means 62 acting between the member 57 and the tubular member 13 allows member 57 to move or "float" slightly (to the left) which then results in a simultaneous axial thrust on each of the paired elements comprising members 57, 58 and members 59 and 60. The paired elements are able to adjust to local conditions and each pair is able to exert a bobbin gripping action essentially without being influenced by the state of the other pair of elements. Thus, accommodation is provided for manufacturing tolerances or accumulated tolerances on chuck parts, ovality, bobbin taper, bobbin over and undersize diameters and the like. On the right end the tapered member 59 rests against a nut 63 on the right end of tubular member 13 and no relative movement takes place between members 59 and 13.

Figure 3:
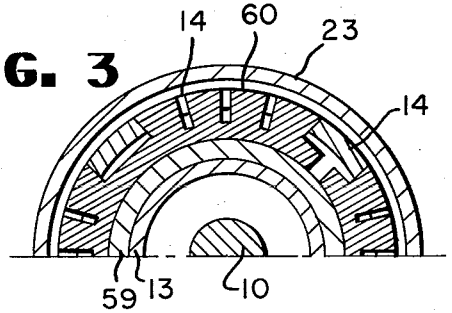
FIG. 3 is a partial transverse cross-section taken along line 3—3 in FIG. 1.
Figure 2:
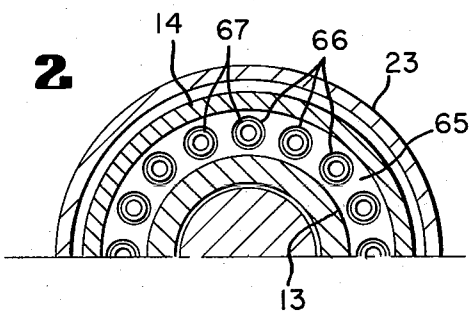
FIG. 2 is a partial transverse cross-section taken along line 2—2 in FIG. 1.
Figure 4:
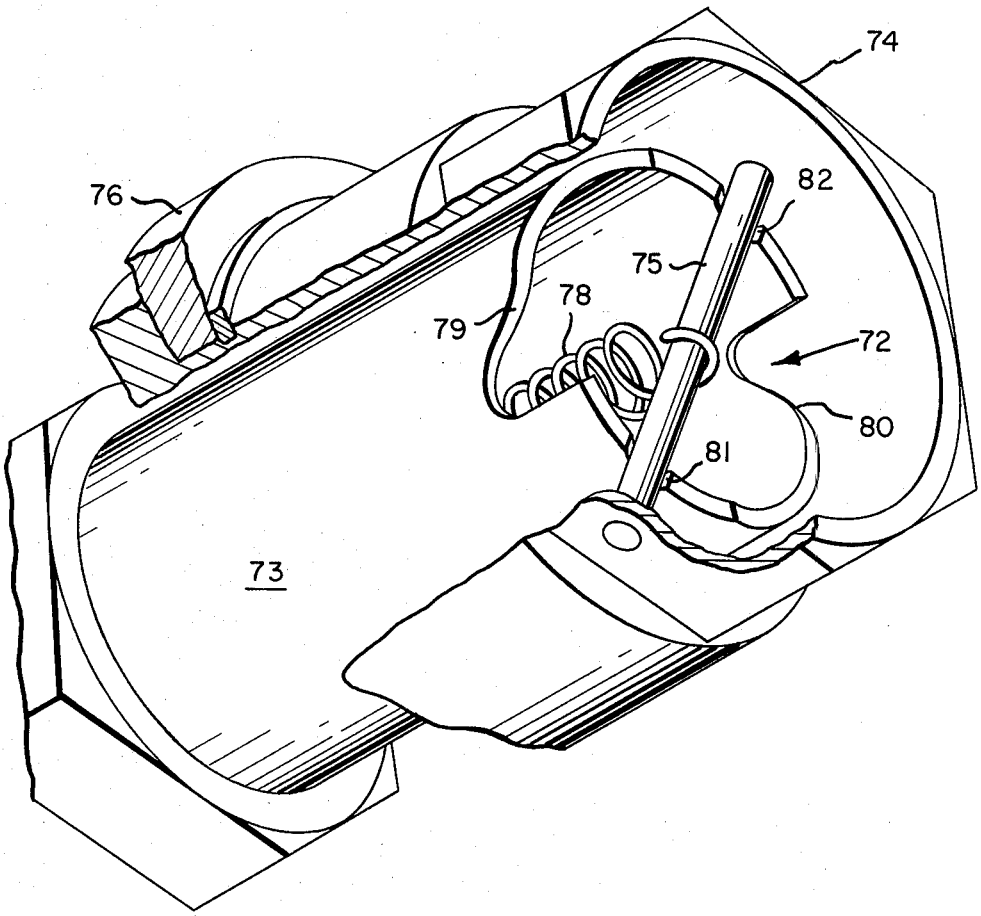
FIG. 4 is an enlarged perspective view, partially broken away, of the lock-out mechanism of the chuck of this invention.

In the annular space between tubular member 13 and sleeve 14 are slidable tubes 64 and 65; these are separable at section line 2—2 and are urged apart by sixteen helical springs 67 in aligned cavities 66 (FIG. 3) in the respective ends of the tubes 64, 65. Since the right end of tube 65 is against tapered member 59, it does not move; the left end of slidable tube 64 is against a snap ring 68 in the inside of sleeve 14 thus urging it to the left. The sleeve 14 is keyed to the rest of the chuck at the left where tongues 69 engage grooves 70 in a band 79 which is secured to the tubular member 13; this prevents relative rotation between sleeve 14 and tubular member 13 when braking effort is applied to the latter by means of a brake shoe which is secured to a swing arm (neither shown) which shoe is arranged to be pivoted outwardly to engage interior surface 13*a* on sleeve 13 to effect the braking. Clearance space 71 allows the sleeve 14 to move axially. The nongripping or release position is shown in FIG. 1 in which the sleeve 14 cannot be moved to the left by springs 67 because a manual lock-out mechanism, on the right, is holding it. The lock-out mechanism, as best shown in FIG. 4, comprises a fixed cam 72 of generally helical shape machined into the end of a tube 73 which is secured to the end of fixed shaft 10 by means of a screw thread; surrounding the outer end of the tube 73 is a hollow knob 74 which is rotatable on the tube 73 so that a transverse pin 75 in the knob can follow the cam 72. An extension spring 78 attached to the end of shaft 10 and to pin 75 pulls the knob to the left. At the apex of the cam 72, i.e., to the right, are notches 81, 82 with which the pin 75 becomes temporarily engaged to "lock-out" the knob and consequently the chuck; the latter is accomplished by means of a flange on the knob which engages a washer 76 which in turn engages a ring 77 inside and fixed to sleeve 14. There are two identical helical portions 79, 80 on cam 72, which are 180° apart, each of which has the same hand and each extends for about 90°. Likewise, there are two notches 81, 82 so that pin 75 engages two cam surfaces or two notches. When the knob is forcibly rotated manually to get the pin 75 free of the notches the springs 67 urge the sleeve 14 to the left thus, the bobbin grippers 58, 60 are likewise drawn to the left against the interfitting tapered members causing the grippers 58, 60 to move outward to forcibly engage a bobbin. As the knob 74 is rotated by about 90° its flange and washer 76 become separated from the ring 77, therefore, the chuck may rotate without rubbing contact at that location.

I claim:

1. A bobbin chuck for mounting replaceable bobbins on the external surface thereof comprising: a shaft; a tubular member mounted for rotation on said shaft and concentric therewith; a sleeve having a plurality of openings disposed in a concentric relationship about said tubular member, said sleeve being movable axially with respect to said tubular member and rotatable therewith; a plurality of camming members carried by said tubular member and supporting said sleeve in said concentric relationship, said camming members having tapered camming surfaces; a plurality of radially and axially movable cam followers having mating surfaces engageable with the camming surfaces and extending through the openings in the sleeve for gripping bobbins on said chuck; resilient means seated against said tubular member and said sleeve for urging said sleeve axially in one direction to urge the mating surfaces of said cam followers against said tapered camming surfaces of said camming members to move said cam followers into a gripping position; and means located at the end of the chuck for moving the sleeve and the cam followers axially in a direction opposite to said one direction to a release position.

* * * * *